US005384818A

United States Patent [19]

Ono et al.

[11] Patent Number: 5,384,818

[45] Date of Patent: Jan. 24, 1995

[54] X-RAY TUBE OF THE ROTARY ANODE TYPE

[75] Inventors: Katsuhiro Ono, Utsunomiya; Hidero Anno, Ootawara; Takayuki Kitami; Hiroyuki Sugiura, both of Tochigi; Makoto Tanaka, Ootawara, all of Japan

[73] Assignee: Kabushiki Kaisha Toshiba, Kawasaki, Japan

[21] Appl. No.: 44,174

[22] Filed: Apr. 8, 1993

[30] Foreign Application Priority Data

Apr. 8, 1992 [JP] Japan ..... 4-114276
Nov. 6, 1992 [JP] Japan ..... 4-296242

[51] Int. Cl.[6] ..... H01J 35/10
[52] U.S. Cl. ..... 378/132; 378/125
[58] Field of Search ..... 378/132, 133

[56] References Cited

U.S. PATENT DOCUMENTS 4,210,371 7/1980 Gerkema et al. .
5,146,483 9/1992 Behling .
5,210,781 5/1993 Ono et al. ..... 378/133
5,224,142 6/1993 Ono et al. ..... 378/132
5,260,983 11/1993 Ono et al. ..... 378/133

FOREIGN PATENT DOCUMENTS 2052473 4/1992 Canada .
2052474 4/1992 Canada .
0477868 4/1992 European Pat. Off. .
0496945 8/1992 European Pat. Off. .
2517880 6/1983 France .
55-78449 6/1980 Japan .
2144836 6/1990 Japan .

*Primary Examiner*—Craig E. Church
*Attorney, Agent, or Firm*—Cushman, Darby & Cushman

[57] ABSTRACT

An X-ray tube of the rotary anode type includes a rotary structure to which an anode target is fixed, a stationary structure fitted into the rotating member, slide bearings arranged between them and provided with spiral grooves, and a lubricant consisting of gallium alloy and supplied to the slide bearings. The rotary structure includes a first rotating member to which the anode target is connected and a second rotating member provided with the bearings. These first and second rotating members are kept coaxial to each other and connected together at their those portions which are remote from the anode target when viewed in the rotating axis direction of the target and along a heat transmitting line extending from the target to the bearings, but heat insulating clearances and are formed between the rotating members at their other portions not connected. The first rotating member is made of one of those materials which have a heat conductivity smaller than 0.1 (cal/cm.sec.°C.) at temperature range of 0° to 500° C. The second rotating member is made of alloy whose main components are iron and nickel, alloy whose main components are iron, nickel and cobalt, alloy whose main components are iron and chromium, alloy whose main components are iron, chromium and nickel, or iron alloy including iron, chromium and one of carbon, molybdenum and tungsten.

10 Claims, 6 Drawing Sheets

X-RAY TUBE OF THE ROTARY ANODE TYPE

BACKGROUND OF THE INVENTION

1. Field of the Invention

The present invention relates to an X-ray tube of the rotary anode type and, more particularly, an improvement of the rotating mechanism for supporting the anode target.

2. Description of the Related Art

As well known, in an x-ray tube of the rotary anode type, a disk-like anode target is fixed to a rotary structure which is rotatably supported by a stationary structure and bearings are formed between the stationary and rotary structure. An electron beam is bombarded on the anode target so that X-rays are radiated from the anode target, while exciting electromagnetic coils located outside a vacuum envelope to rotate the rotary structure at high speed. Ball bearings have been used for a long time but it is now expected that bearings of the hydro-dynamic pressure type will become used. In the case of this dynamic pressure type bearings, spiral grooves are formed on the bearing face and liquid metal such as gallium (Ga) and alloy of gallium, indium and tin (Ga-In-Sn) is used as lubricant. Examples in which the dynamic pressure type bearings are used are disclosed in Japanese Patent Publication 60-21463, Japanese Patent Disclosures 60-97536, 60-117531, 61-2914 and 60-287555, for example.

The rotary structure by which the anode target is supported usually includes an outer cylinder made of copper, high in electric conductivity, to serve as a rotor, and a target support welded integral to the rotor is soldered. Rotating magnetic field is applied from a stator located outside the vacuum envelope to the rotor to rotate the rotor at high speed according to the principle of the induction motor. In the case of the X-ray tube in which the ball bearings are used, noises become larger as the temperature of the ball bearings rises higher. This is because the clearance between the bearings is changed and because solid lubricant is fatigued. Various kinds of measure have been proposed to suppress the temperature rise in the ball bearings. Some of them are disclosed in Japanese Patent Disclosures 55-3180, 55-78449 and 2-144836. However, they have not become practically used yet.

The X-ray tube in which the hydro-dynamic pressure type bearings are used is characterized in that rotating noises are hardly created. The X-ray diagnostic instrument in which the X-ray tube is incorporated is often used in intense coldness or at a temperature lower than 0° C. It is therefore preferable that lubricant is made of materials whose melting points are low. Ga alloys are the most suitable for use as lubricant because their vapor pressures are low and their melting points are equal to or near to 10° C.

When one of these Ga alloys is used is lubricant, however, the following drawbacks are caused. Ga alloys are so active as to react with bearing component members. As the result, the clearance between bearings is gradually changed to deteriorate the rotating characteristics of bearings. This limits those materials, of which the bearings are made, to tungsten (W), molybdenum (Mo), tantalum (Ta), niobium (Ni) and alloys of them, which cannot be corroded by Ga alloys. Copper (Cu), tin, iron (Fe), nickel (Ni) and iron alloy such as stainless steel, however, are low in cost and easy to be processed. But they are regarded as being impractical because they can be quite easily corroded. The reaction of bearing component materials with Ga alloys is more remarkable as temperature becomes higher. In order to prevent the bearing component materials from being corroded by Ga alloy, it is now well known that cooling medium is introduced into the bearing component members to forcedly cool the bearing sections. In the case of this X-ray tube, however, a unit for circulating the cooling medium through the system must be added. This makes the X-ray instrument complicated and it is quite undesirable.

U.S. Ser. No. 766,276, filed Sep. 27, 1991, Ono et al, discloses an X-ray tube of the rotary anode type which is provided with a measure for solving the above-mentioned thermal troubles. It is asked, however, that the thermal measure of this X-ray is further improved.

SUMMARY OF THE INVENTION

The object of the present invention is therefore to provide an X-ray tube of the rotary anode type wherein bearings of the hydro-dynamic pressure type, although made of such materials as iron alloys low in cost and easy to be processed, cannot be corroded by metal lubricant such as Ga alloy to thereby keep their rotating characteristics more stable for a longer time.

According to an aspect of the present invention, there is provided an X-ray tube of the rotary anode type comprising an anode target;

a rotary structure to which the anode target is fixed, including a first rotating member to which the anode target is mechanically connected, the first rotating member being made of one of those materials which have a heat conductivity smaller than 0.1 (cal/cm.sec.° C.) at a temperature range of 0° to 500° C.

stationary structure for rotatably supporting the rotary structure;

slide bearings formed between the rotary and the stationary structures and including spiral grooves; and a liquid metal lubricant applied to the slide bearings;

It is more preferable that the first rotating member is made of material whose heat conductivity is lower than 0.08 (cal/cm.sec.° C.) at a temperature range of 0° to 500° C.

According to an X-ray tube of the rotary anode type of the present invention, temperature rises in slide bearing component members and in Ga alloy lubricant supplied into these members can be reduced with higher reliability and the bearing component members are hardly corroded by Ga alloy. Although made of materials low in cost and easy to accurately be processed, the bearings can keep their rotating characteristics more stable for a longer time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
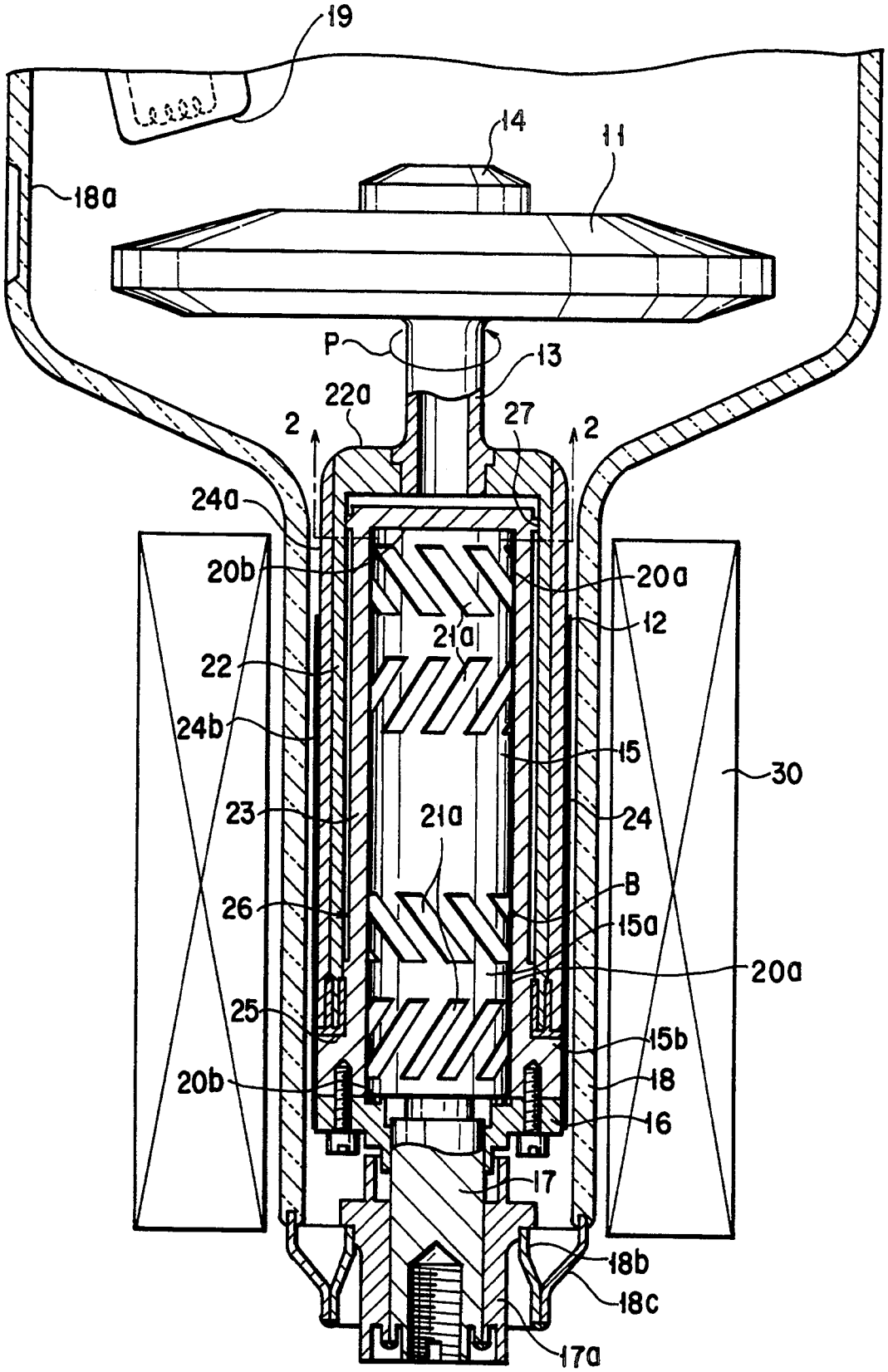
FIG. 1 is a vertically-sectioned view showing showing the main portion of the X-ray tube of the rotary anode type according to an embodiment of the present invention.
Figure 2:
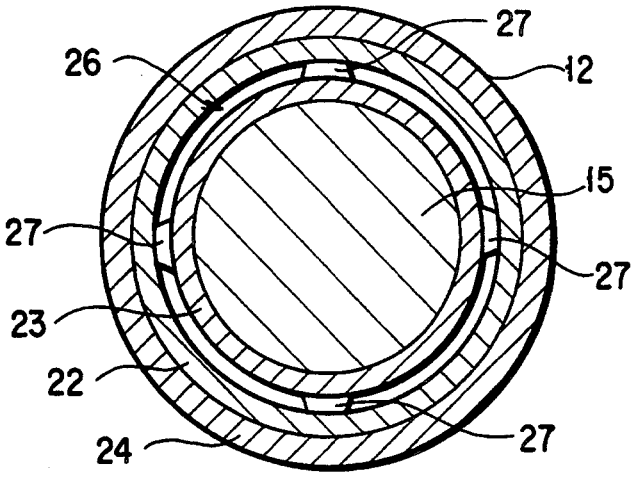
FIG. 2 is a sectional view taken along a line 2—2 in FIG. 1.

Some embodiments of the present invention will be described with reference to the accompanying drawings. Same components of these embodiments will be denoted by same reference numerals in this case.

Figure 3:
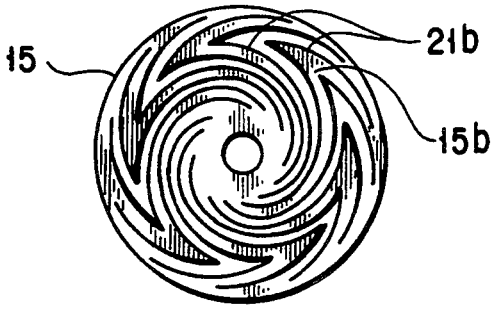
FIG. 3 is a top view showing a part of the rotary anode type X-ray tube.
Figure 4:
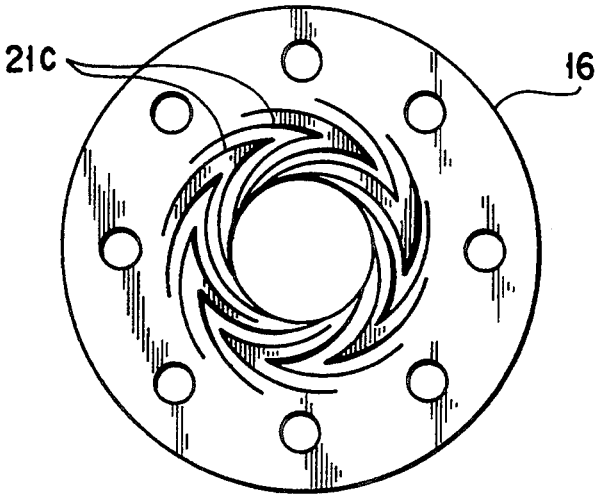
FIG. 4 is a top view showing another part of the rotary anode type X-ray tube.

An embodiment of the present invention shown in FIGS. 1 through 4 has the following arrangement. A disk-like anode target 11 is connected and fixed integral to a shaft 13, which is made of Mo alloy and which is projected from one end of a cylindrically rotary structure 12, by means of a fixing screw 14. A stationary structure 15 is fitted into the cylindrical rotary structure 12 and a disk-like closing member 16 is fixed to the lower end of the rotary structure 12. A lower end portion 17 of the stationary structure 15 is connected airtight to the cylindrical glass section of a vacuum envelope 18 through an auxiliary metal ring **17*a* and thin seal rings 18*b* and 18*c*. The vacuum envelope 18 has a large-diameter portion by which the anode target 11 is enclosed, and a window 18*a* through which X-ray is radiated outside the housing 18. A cathode 19 is arranged in opposite to the anode target 11. Radial and thrust slide bearings 20*a* and 20*b* of the hydro-dynamic pressure type which are disclosed in the above-mentioned references are arranged between the cylindrical rotary structure 12 and the stationary structure 15 fitted in the structure 12. Each of the two radial slide bearings 20*a* which are arranged along the rotating axis and which are separated from each other has two herringbone spiral pattern grooves 21*a* formed on an outer circumference 15*a* of the stationary structure 15. One of the two thrust slide bearings 20*b* has circle-like herringbone spiral pattern grooves 21*b* formed on an end face 15*b* of the stationary structure 15 as shown in FIG. 3. The other has circle-like herringbone spiral pattern grooves 21*c* shown in FIG. 4 and formed on the top of a disk-like flange 16 with which the end face of the stationary structure 15 is contacted. Each of those slide bearing faces of the rotary structure may be made flat or provided with spiral grooves if necessary. When being made operative, both of these rotary and stationary structures are kept to have a clearance of 20 μm between their bearing faces and liquid metal lubricant (not shown) of a gallium alloy such as Ga, GaIn and Ga-In-Sn alloy is supplied into these gas or clearances and spiral grooves. In addition, a bismuth alloy such as Bi-In-Pb-Sn, In-Bi and In-Bi-Sn alloy may be used as the metal lubricant. Stators 3 each having an electromagnetic coil are located symmetrical to each other and in opposite to the rotary structure 12 with the vacuum envelope 18 interposed between them. Rotating magnetic field is thus generated by these stators 3 to cause the anode target 11 to be rotated at high speed and in a direction shown by an arrow P. Electron beam emitted from the cathode 19 is bombarded on the anode target 11 to irradiate X-ray. Heat thus produced in the target 11 is radiated but a part of it is transmitted to the bearings 20*a* and 20*b* through the shaft 13 and the rotary structure 12**.

In order to decrease this heat transmission, the rotary structure 12 includes a first rotating member or intermediate cylinder 22 connected integral to the anode target 11 through the shaft 13, a second rotating member or inner bottom-provided cylinder 23 fitted into the first rotating cylinder 22 with a heat insulating clearance interposed between them, and an outer cylinder 24 made of copper and fitted onto the intermediate cylinder 22. The inner bottom-provided cylinder 23 cooperates with the outer circumference of the stationary structure 15 at some parts of its inner face to form the slide bearing faces. The width of the heat-insulating clearance 26 is in a range of 0.1 to 1 mm in the radial direction or 0.5 mm, for example. The inner cylinder 23 whose inner face serves as the slide bearing face of the dynamic pressure type is made of pure iron, iron alloy tool steel such as stainless steel and SKD-11 (JIS) and nickel, which are low in cost, good in process-ability, comparatively high in strength and made well wet by Ga alloy lubricant. The inner cylinder 23 is provided with four small projections 27 projected from the upper outer circumference thereof and these four projections 27 enable the inner cylinder 23 to be contacted with the inner face of the intermediate cylinder 22 at a small contact area and both of the inner and intermediate cylinders 23 and 22 to be kept at a correct axial position while keeping the heat-insulating clearance 26 between them.

As will be described later, the intermediate cylinder 22 is made of such material that has a thermal conductivity sufficiently smaller than that of pure iron, smaller than 0.1(cal/cm.sec.°C.), preferably smaller than 0.08 (cal/cm.sec.° C.) at a temperature range of 0° to 500° C. It is fixed to the shaft 13 at its upper end and partly connected to the inner cylinder 23 at its lower end by soldering parts 25 which are located adjacent to the radial slide bearings **20*a* remote from the anode target 11. When viewed in the rotating axis direction and along the heat transmitting path, therefore, the intermediate and inner cylinders 22 and 23 are connected integral to each other at the position remote from the anode target 11 but kept separated from each other at their other remaining portions by the heat insulating clearance or area 26**.

When the efficiency of applying rotating magnetic field to the intermediate and inner cylinders 22 and 23 is considered, it is preferable that at least one of these cylinders is made of ferromagnetic material. The other cylinder 24 is made of copper or copper alloy which has a specific electric resistance smaller than $6\times10^{-8}$ (Ω.cm) at a temperature of 20° C. The intermediate and outer cylinders 22 and 24 may be arranged coaxial, having a heat insulating clearance of 0.5 mm or less between them, but not between those portions which are connected to each other by soldering parts 25. When arranged in this manner, temperature rise in their bearing sections can be further reduced.

Further, those faces **22*a* and 24*a* of the intermediate and outer cylinders 22 and 24 which are opposed to the anode target 11 are made into mirror surfaces. Heat radiated from the anode target 11 can be thus reflected by these mirror faces 22*a* and 24*a* to thereby suppress the temperature rise in the bearing sections. Still further, that outer circumference of the outer cylinder 24, except the mirror face 24*a*, is coated by a black coating 24*b*, by which heat reached the outer cylinder 24** can be dispersed by radiation to thereby further suppress the temperature rise in the bearing sections.

The inner cylinder 23 whose inner face serves as the bearing one is made of preferably one of the following materials which can be easily processed and which have a heat conductivity substantially equal to or near that of the intermediate cylinder 22.

Alloy whose main components are iron and nickel; alloy whose main components are iron, nickel and cobalt; alloy whose main components are iron and chromium, said iron including therein various kinds of stainless steel, and alloy whose main components are iron, chromium and nickel; and iron alloy including iron, chromium and at least one of carbon, vanadium, molybdenum, and tungsten, said iron including therein tool steel.

The stationary structure 15 is made of preferably one of the above-mentioned materials of which the inner cylinder 23 is made, but it may be made of W, Ta, Nb, or alloy whose main component is at least one of these materials, or ceramics which can be made wet by Ga alloy.

The intermediate cylinder 22 is made of one of the following materials which have a heat conductivity smaller than 0.1 (cal/cm.sec.° C.) at a temperature range of 0° to 500° C.

Alloy whose main components are iron and nickel; alloy whose main components are iron, nickel and cobalt; alloy whose main components are iron and chromium, said iron including therein various kinds of stainless steel, and alloy whose main components are iron, chromium and nickel; iron alloy including iron, chromium and at least one of carbon, vanadium, molybdenum and tungsten, said iron including therein tool steel; and ceramics which can be made wet by Ga alloy.

Heat conductivities and temperatures resultant in a bearing section B in the case of our examples which are made of the above-mentioned materials are shown in Table 1 for comparison. When ceramics whose electric resistance is high is used, it is needed that conductive film is coated on a part of the surface of the ceramics to form a path through which anode current flows. Temperatures resultant in the bearing section B represent those highest values which could be calculated when electron beam input of 240 W was continuously applied to the anode target in the case of our examples which are same in structure and dimension. Comparison examples which were made of pure iron and nickel are also shown in Table 1.

TABLE 1

| | Composition (%) | Heat conductivity (cal/cm·sec·°C.) 0° C. | 500° C. | Temperature (°C.) |
|---|---|---|---|---|
| Example 1 | Fe:50<br>Ni:50 | 0.037 | 0.048 | 120 |
| Example 2 | Ni:29<br>Co:17<br>Fe:Remainder | 0.040 | 0.052 | 120 |
| Example 3 | Ni + Co ≧ 72<br>Cr:14 to 17<br>Fe:6 to 10 | 0.036 | 0.052 | 120 |
| Example 4 | (SUS304)*<br>Ni:8 to 11<br>Cr:18 to 20<br>C ≦ 0.08<br>Fe:Remainder | 0.039 | 0.051 | 140 |
| Example 5 | (SUS403)*<br>Ni ≦ 0.6<br>Cr:11.5 to 13<br>C ≦ 0.15<br>Fe:Remainder | 0.060 | 0.069 | 140 |
| Example 6 | (SKD11)*<br>Cr:11 to 13<br>Mo:0.8 to 1.2<br>C:1.4 to 1.6<br>Fe:remainder | 0.057 | 0.062 | 140 |
| Example 7 | (SKH51)*<br>Cr:3.8 to 4.5<br>Mo:4.5 to 5.5<br>W:5.5 to 6.7<br>V:1.6 to 2.2<br>C:0.8 to 0.9<br>Fe:Remainder | 0.050 | 0.054 | 130 |
| Example 8 | $Al_2O_3$<br>Ceramics | 0.072 | 0.021 | 120 |
| Example 9 | $ZrO_2$<br>Ceramics | 0.004 | 0.005 | 85 |
| Example 10 | $Si_3N_4$<br>Cramics | 0.040 | 0.012 | 100 |
| Comparative example 1 | Iron (Fe) | 0.18 | 0.10 | 250 |
| Comparative example 2 | Ni | 0.21 | 0.16 | 270 |

(Note) *JIS notation

As apparent from Table 1, the temperature resultant in the bearing section when the X-ray tube of the rotary anode type whose bearing members are made of the materials used for our examples in Table 1 is under operation can be suppressed lower than about 200° C. Even when the bearing members are made of the above-mentioned iron alloys, therefore, their bearing faces are hardly corroded to thereby enable their dynamic pressure type slide bearings to be more stably used for a longer time.

Figure 5:
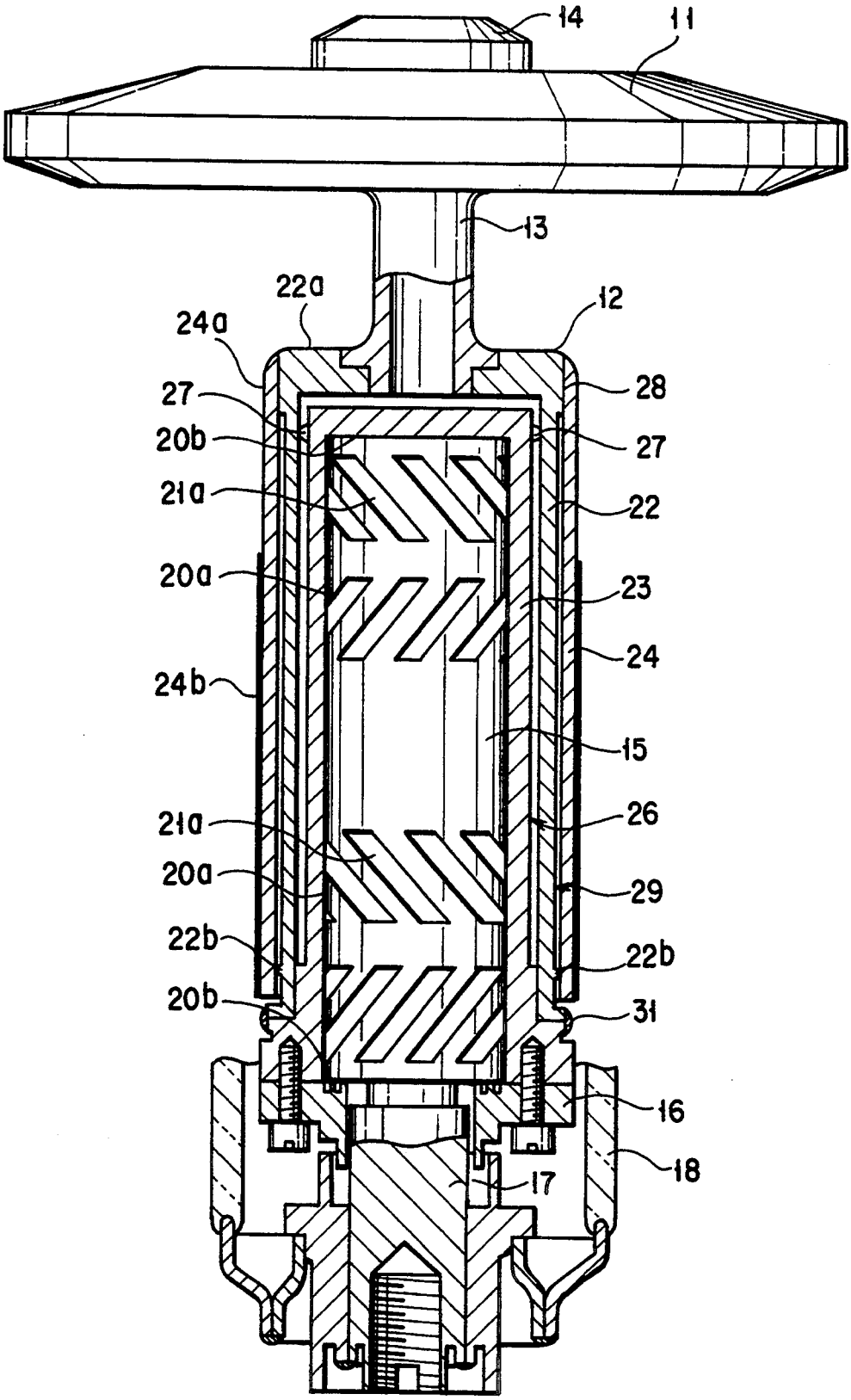
FIG. 5 is a vertically-sectioned view showing the main portion of the rotary anode type X-ray tube according to another embodiment of the present invention.

In the case of another embodiment shown in FIG. 5, that upper end portion of the outer cylinder 24 which is located adjacent to the anode target 11 is partly connected to the intermediate cylinder 22 by soldering parts 28, while leaving the other portion thereof separated from the intermediate cylinder 22 to form a second heat insulating clearance 29 between them. Heat transmitted from the anode target to the bearing section through the outer cylinder can be thus reduced to thereby further suppress temperature rise in the bearing section. The outer cylinder 24 is point-contacted with the intermediate cylinder 22 at the lower end portion thereof through four projections 22b which are projected from the outer circumference of the intermediate cylinder 22 and which are located on a circumferential line on the cylinder 22. Both of the outer and intermediate cylinders 24 and 22 can be thus kept at a correct coaxial position. It may be arranged that plural grooves are formed on the inner face of the outer cylinder 24 and that tips of the projections 22b are fitted into their corresponding grooves. When the X-ray tube is under operation, the rotating force of the outer cylinder 24 can be thus more efficiently transmitted to the intermediate cylinder 22 and then to the inner cylinder 23, so that excessive stress added to the soldering parts 28 can be reduced.

In the case of this second embodiment, the lower end of the intermediate cylinder 22 is connected to the lower end portion of the inner cylinder 23 at such position that is adjacent to the radial slide bearing 20a remote from the anode target 11. Most of the other portion thereof cooperates with the inner cylinder 23 to form the heat insulating clearance 26.

Figure 6:
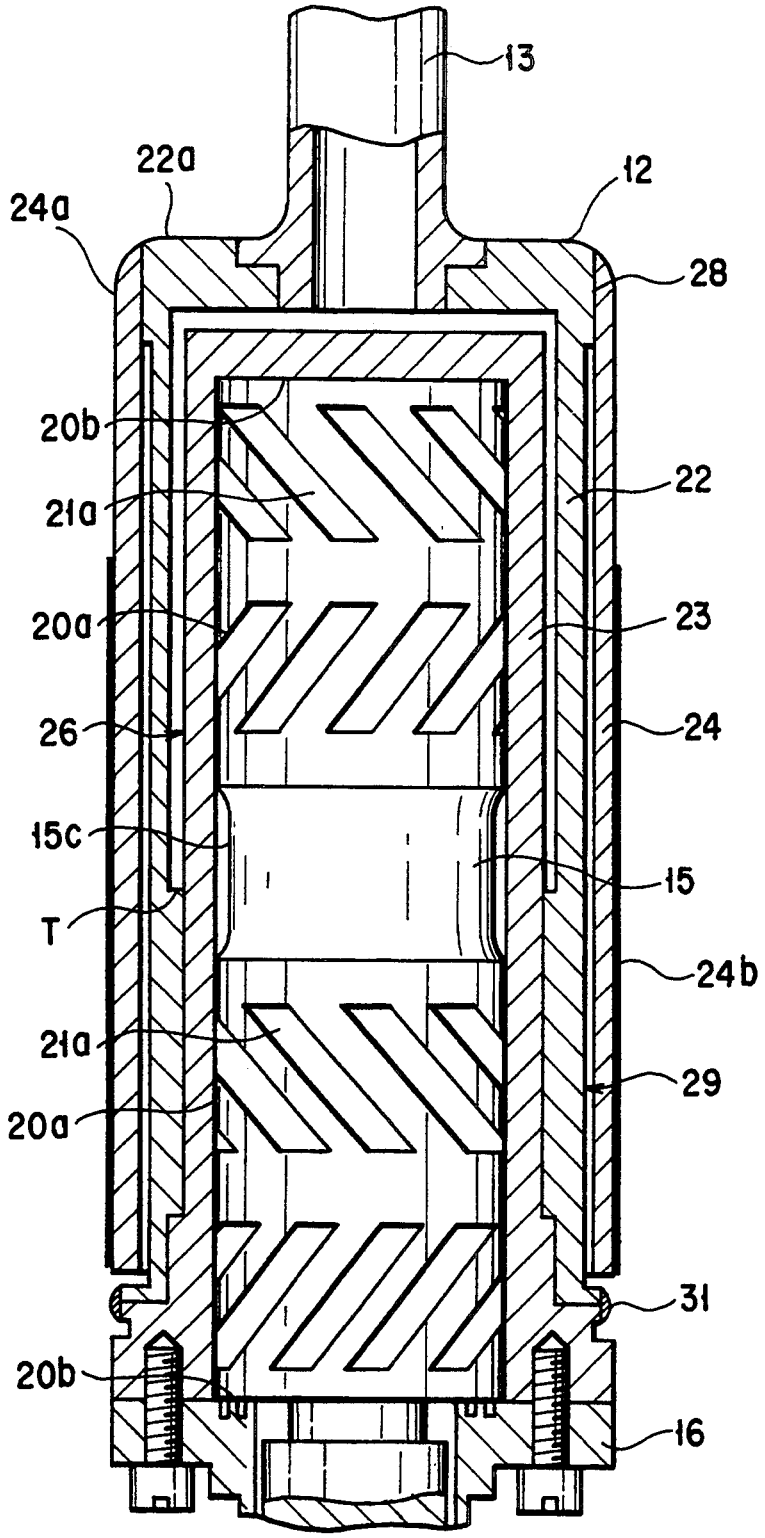
FIG. 6 is a vertically-sectioned view showing the main portion of the rotary anode type X-ray tube according to a further embodiment of the present invention.

In the case of a further embodiment shown in FIG. 6, the heat insulating clearance 26 is formed between the intermediate and inner cylinders 22 and 23 at such an area that is nearer to the target when viewed from a center point T of the rotating axis between two radial slide bearings 20a and along the heat transmitting line, but the other portions of these cylinders which are remoter from the target are closely contacted with each other. A ring-shaped recess 15c is formed round the center portion of the stationary structure 15. According to this third embodiment, the mechanical contact of the intermediate cylinder 22 relative to the inner cylinder 23 can be made stronger to more stably support and rotate a heavier anode target.

Figure 7:
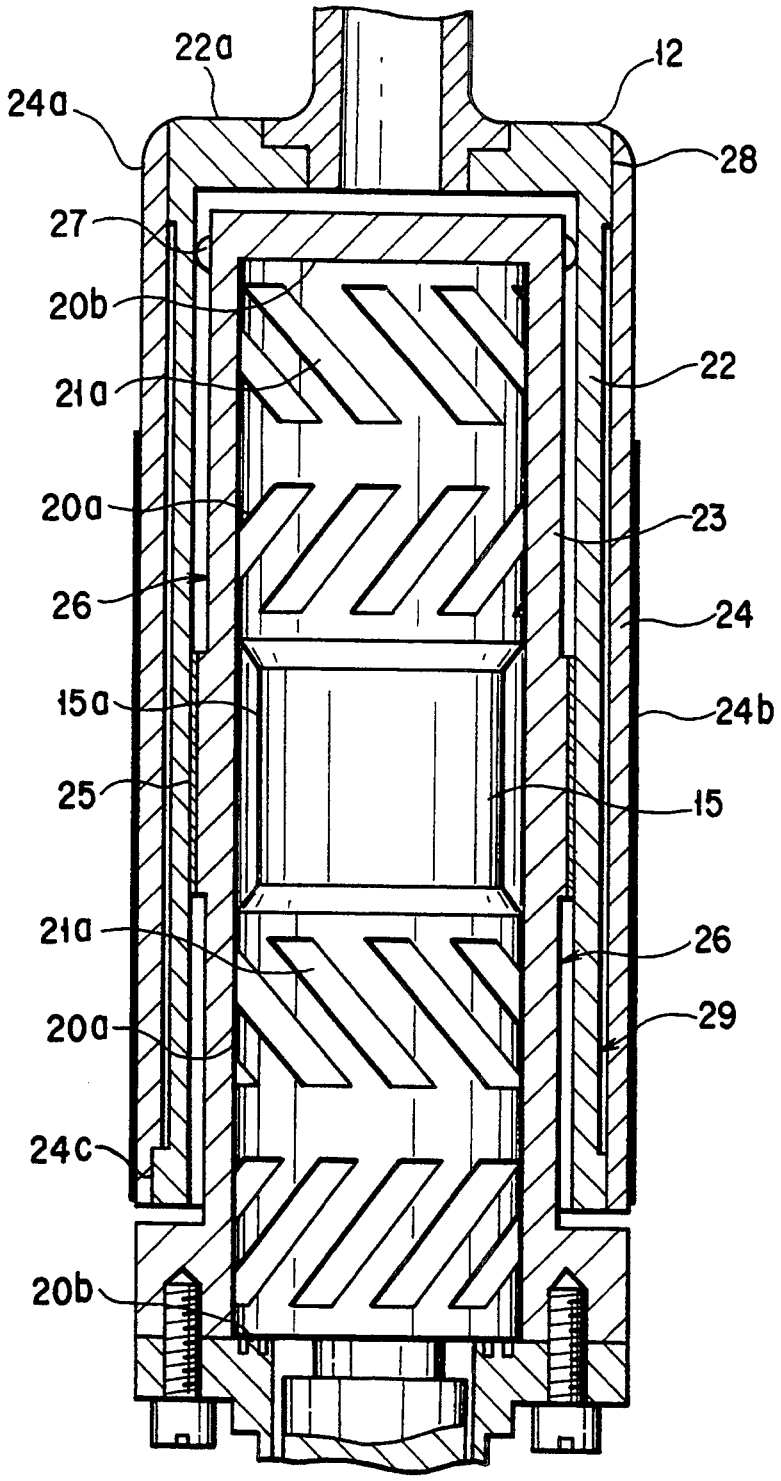
FIG. 7 is a vertically-sectioned view showing the main portion of the rotary anode type X-ray tube according to a still further embodiment of the present invention.

According to a still further embodiment shown in FIG. 7, the inner cylinder 23 is welded to the intermediate cylinder 22 at a position which corresponds to the center recess 15c of the stationary structure 15. This welded portion between the intermediate and inner cylinders 22 and 23 is denoted by reference numeral 25. The heat insulating clearances 26 are formed between the intermediate and inner cylinders 22 and 23 but on both sides of the welded portion when viewed in the rotating axis direction. Upper end portions of the intermediate and outer cylinders 22 and 24 which are nearer to the anode target are connected to each other by soldering parts 28, while their lower end portions 24c are mechanically fitted to each other by wave-shaped concaves and convexes which are formed on inner and outer faces thereof in the circumferential direction. Stress concentration on the soldering parts 28 caused by rotating drive force transmitted from the outer cylinder to the intermediate one can be thus reduced.

Figure 8:
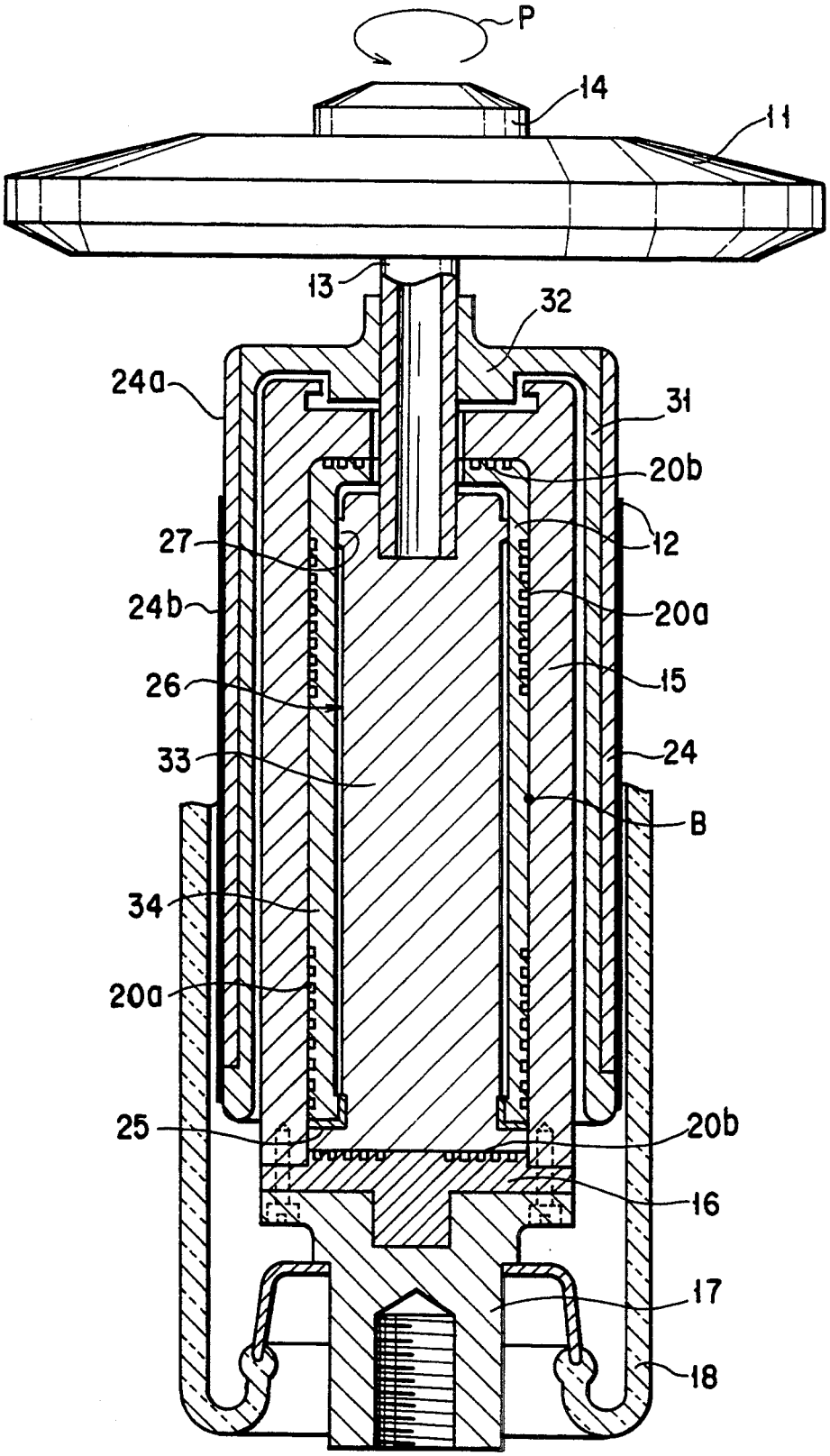
FIG. 8 is a vertically-sectioned view showing the main portion of the rotary anode type X-ray tube according to a still further embodiment of the present invention.

According to a still further embodiment shown in FIG. 8, the column-like rotary structure 12 connected integral to and rotated together with the anode target 11 is housed in the cylinder-shaped stationary structure 15. The stationary structure 15 has in the top thereof a through-hole through which the rotating shaft 13 is passed, and a disk-like closing member 16 and a anode support 17 are fixed to the open bottom of the stationary structure 15 by plural screws. The closing member 16 is contacted with the lower end face of the rotary structure 12 and provided with a spiral groove 21c on its contacted face. A ferromagnetic cylinder 31 which serves is the rotor of a motor is arranged round the stationary structure 15 and the outer cylinder 24 made of copper is arranged round the cylinder 31. The top of the cylinder 31 is mechanically and strongly fixed to the rotating shaft 13.

The rotary structure 12 includes a first column-like rotating member 33 to which the rotating shaft 13 for supporting the anode target 11 is fixed, and a second cylinder-like rotating member 34 coaxially fitted onto the first rotating member 33 and serving to form the slide bearing face. These first and second rotating members 33 and 34 are connected integral to each other by soldering parts 25 at their lower end portions which are located remoter from the anode target when viewed in the axial direction and along the heat transmitting line. The heat insulating clearance 26 is formed between the first and second rotating members 33 and 34 except those portions thereof which are connected to each other by the soldering parts 25. These rotating members 33 and 34 can be kept therefore substantially not contacted. Four projections 27 are projected from the upper end portion of the first rotating member 33 and contacted with the inner face of the second rotating member 34. They can be thus stably kept coaxial. The outer circumference and the top of the second rotating member 34 form bearing faces of the dynamic pressure type bearings 20a and 20b and herringbone pattern spiral grooves are formed on them. The heat transmitting line extending from the anode target to the bearings can have a larger heat resistance due to the heat insulating clearance 26.

The heat insulating areas 26 and 29 may not be spacial clearances. Ceramics whose heat conductivity is quite small, and other heat insulating materials may be used instead.

According to the present invention as described above, temperature rises in the bearing component members and in Ga alloy lubricant supplied to them can be more reliably reduced when the X-ray tube is under operation. In addition, the bearing component members can be hardly corroded by Ga alloy. An X-ray tube of the rotary anode type, lower in cost and capable of keeping its bearing characteristics more stable for a longer time, can be thus provided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An X-ray tube of the rotary anode type comprising an anode target;

a rotary structure to which the anode target is fixed, a stationary structure for rotatably supporting said rotary structure;

slide bearings formed between the rotary and the stationary structures and including spiral grooves; and a liquid metal lubricant applied to the slide bearings;

wherein said rotary structure includes a first rotating member to which the anode target is mechanically connected, said first rotating member being made of one of those materials which have a heat conductivity smaller than 0.1(cal/cm.sec.°C.) at a temperature range of 0° to 500° C.

2. According to claim 1, wherein said rotary structure includes a second rotating member which is coaxially arranged in said first rotating member and is coupled to said first rotating member.

3. According to claim 2, wherein said second rotating member is made of one material of pure iron, nickel and iron alloy.

4. According to claim 2, wherein said second rotating member is made of one of alloy whose main components are iron, nickel and cobalt, alloy whose main component are iron and chromium, alloy whose main component iron, chromium and nickel, and iron alloy including iron, chromium and at least one of carbon, vanadium, molybdenum and tungsten.

5. According to claim 2, wherein said rotary structure have one end to which said anode target is fixed, the other end and a coupling section at which said first and second rotating members are coupled to each other and is provided at the other end of rotary structure.

6. According to claim 5, wherein said rotary structure is provided with means for insulating heat, which is provided between said first and second rotating members.

7. According to claim 5, wherein one of said first and second rotating members has projections at the one end of said rotary structure, said first and second rotating members being aligned with the projections.

8. The X-ray tube of the rotary anode type according to claim 1, wherein said first rotating member is made of alloy whose main components are iron and nickel, alloy whose main components are iron, nickel and cobalt, alloy whose main components are iron and chromium, alloy whose main components are iron, chromium and nickel, iron alloy including iron, chromium and at least one of carbon, vanadium, molybdenum and tungsten, or one of ceramics.

9. According to claim 5, further comprising a cylinder made of copper or copper alloy, into which said first rotating member is coaxially fitted.

10. According to claim 9, wherein said cylinder and said first rotating member are coupled to each other by a second coupling section which is provided at the one end of said rotary structure.

* * * * *